US005886345A

United States Patent [19]

Köster et al.

[11] Patent Number: 5,886,345

[45] Date of Patent: Mar. 23, 1999

[54] ACCURATE MASS DETERMINATION WITH MALDI TIME-OF-FLIGHT MASS SPECTROMETERS USING INTERNAL REFERENCE SUBSTANCES

[75] Inventors: Claus Köster, Lilienthal; Jochen Franzen, Bremen; Armin Holle, Oyten, all of Germany

[73] Assignee: Bruker Daltonik GmbH, Bremen, Germany

[21] Appl. No.: 918,087

[22] Filed: Aug. 25, 1997

[30] Foreign Application Priority Data

Sep. 3, 1996 [DE] Germany ..... 196 35 646.6

[51] Int. Cl.[6] ..... H01J 49/40

[52] U.S. Cl. ..... 250/282; 250/287; 250/252.1

[58] Field of Search ..... 250/282, 287, 250/252.1

[56] References Cited

U.S. PATENT DOCUMENTS 5,504,326 4/1996 Reilly et al. ..... 250/282

OTHER PUBLICATIONS

Robert S. Brown et al, Mass Resolution Improvement by Incorporation of Pulsed Ion Extraction in a Matrix–Assisted Laser Desorption/Ionization Linear Time–of–Flight Mass Spectrometer, Analytical Chemistry, vol. 67, No.13, pp. 1998–2003, Jul. 1, 1995.

Johann M. Grundwurmer et al., High–resolution mass spectrometry in a linear time–of–flight mass spectrometer, International Journal of Mass Spectrometry and Ion Processes, vol., 131, pp. 139–148, 1994.

*Primary Examiner*—Jack I. Berman

[57] ABSTRACT

The invention relates to the exact mass determination of analyte ions in time-of-flight mass spectrometers with ionization of analyte substances on sample supports by matrix-assisted laser desorption (MALDI), and with an improvement in mass resolution by delayed ion acceleration in the field between the sample support and an intermediate electrode. It particularly relates to methods for subsequent correction of the flight time values if, during the scan, an incorrect adjustment of the distance from the sample support to the nearest acceleration electrode has occurred.

The invention obtains a correction parameter for the flight times of all ions in the spectrum from an internal reference substance and corrects all flight times using a quadratic correction equation, before using the calibrated mass scale for the calculation of the exact masses. The quadratic correction equation contains a control parameter which multiplicatively affects both the linear and quadratic correction term. If no better suitable reference ions are available, oligomeric ions from the matrix of the MALDI method may be used as reference ions. The method can be applied regardless of adjustment in the optimum focus range before measurement of the spectrum, if the adjustments were made in a particular manner.

5 Claims, 1 Drawing Sheet

ACCURATE MASS DETERMINATION WITH MALDI TIME-OF-FLIGHT MASS SPECTROMETERS USING INTERNAL REFERENCE SUBSTANCES

The invention relates to the exact mass determination of analyte ions in time-of-flight mass spectrometers with ionization of analyte substances on sample supports by matrix-assisted laser desorption (MALDI), and with an improvement in mass resolution by delayed ion acceleration in the field between the sample support and an intermediate electrode. It particularly relates to methods for subsequent correction of the flight time values if, during the scan, an incorrect adjustment of the distance from the sample support to the nearest acceleration electrode has occurred.

The invention obtains a correction parameter for the flight times of all ions in the spectrum from an internal reference substance and corrects all flight times using a quadratic correction equation, before using the calibrated mass scale for the calculation of the exact masses. The quadratic correction equation contains a control parameter which multiplicatively affects both the linear and quadratic correction term. If no better suitable reference ions are available, oligomeric ions from the matrix of the MALDI method may be used as reference ions. The method can be applied regardless of adjustment in the optimum focus range before measurement of the spectrum, if the adjustments were made in a particular manner.

PRIOR ART

Among the methods for ionization of macromolecular substances on sample supports, matrix-assisted desorption by a laser flash (MALDI) has found the widest acceptance. After leaving the surface, the ions generally have a substantial average velocity which is the same to a large extent for ions of all masses, and a large spread around the average velocity. The average velocity leads to a non-linear relationship between the flight time and root of the mass. The spread leads to a low mass resolution and when measuring the signals of individual ion masses, however there are methods which improve mass resolution. The relationship for conversion of flight time into mass is called "mass scale" here for the sake of simplicity.

For ionization by matrix-assisted laser desorption (MALDI), the large sample molecules are stored on a sample support in or on a layer of low-molecular matrix substance. A laser light pulse of a few nanoseconds duration focused onto the sample surface, vaporizes a small amount of the matrix substance in a quasi-explosive process, whereby the sample molecules are also transferred into the initially tiny vapor cloud.

The vapor cloud expanding into the vacuum not only accelerates the molecules and ions of the matrix substance through its adiabatic expansion, but also the molecules and ions of the sample substance through viscose entrainment, which thereby receive higher kinetic energies than those of thermal equilibrium. Even without an accelerating field, the ions attain average velocities of about 500 to 1,000 meters per second, dependent upon the energy density of the laser beam; the velocities are to a large extent independent of the mass of the ions, however they have a large spread of velocity which ranges from about 200 up to 2,000 meters per second.

The ions accelerated in the ion source with electrical fields at energies of around 10 to 30 kilo-electronvolt (keV), are shot into the flight path of the mass spectrometer and detected with high time resolution at the end of the flight path. From their flight time, their mass-to-charge ratio can be determined. Since this type of ionization practically supplies only singly charged ions, we will use in the following the term "mass determination" instead of the more precise term "determination of the mass-to-charge ratio".

Flight times are converted into masses via a calibration curve, the acquisition of this calibration curve being called "calibration of the mass scale" of the time-of-flight spectrometer. The calibration curve can be stored in table form as a sequence of value pairs, flight times and masses (or flight times and square root of masses), in the memory of the data processing system, or in the form of parameter values for a mathematical function describing the mass relative to the time of flight.

For these measurements, the flight time t for small ions must be determined exactly to within fractions of a nanosecond. The centroid of the line profile is normally used for the measurements. The line profile is scanned according to current technology using a transient recorder with 1 or 2 gigahertz. Transient recorders with 4 gigahertz are in the introductory phase. Generally, the measurements from several measurement cycles are cumulated before the centroid is created.

During formation of the vapor cloud, a small part of the molecules, and these are both matrix and sample molecules, are ionized. But also during expansion of the vapor cloud, continuous ionization of the large molecules takes place through further ion-molecule reactions at the cost of the smaller matrix ions. The large spread of velocities and the time-smeared formation process of the ions limit the mass resolution both of linear as well as energy-focussing reflector type time-of-flight mass spectrometers.

A method for the improvement of mass resolution under these conditions has been known for some time. The ions of the cloud are first allowed to fly a brief time $\tau$ in a drift region without any electrical acceleration. The faster ions thereby distance themselves further from the sample support electrode than the slow ions, and the distribution of the ions' velocities results in a spatial distribution. Only then the acceleration of the ions is switched on. The faster ions are then further away from the sample support electrode, and therefore are accelerated from a reduced accelerating potential, which gives them a somewhat lower final velocity in the drift region of the time-of-flight spectrometer than the initially slower ions. With correct selection of the time lag $\tau$ and potential drop (i.e. the strength of the acceleration field), the initially slower, but after acceleration faster ions catch up again with the initially faster, but after acceleration slower ions exactly at the detector. In this way, ions are dispersed at the location of the detector relative to the mass, but if of equal mass, are focussed in first order relative to the flight time. In this way, a relatively high mass resolution is achieved even in linear time-of-flight mass spectrometers. There is a similar method for time-of-flight spectrometers with reflectors, by which even second order focussing is achieved.

Delayed ion acceleration need not be connected to a switching of the entire accelerating voltage U. Switching of such high voltages in extremely short times of a few nanoseconds is still almost unattainable today and associated with high costs. Switching of a partial accelerating voltage V is sufficient if an intermediate electrode is installed in the acceleration path. Then only the space between the sample support electrode and the intermediate electrode, which have a relatively small distance d from one another, need be field-free at first and then switched over after a delay time $\tau$ into an acceleration field with a strength of V/d. The distance d of the sample support to the intermediate electrode should be as small as possible in order to switch the lowest possible voltages V. There is a lower limit of about 1 mm for this distance which is hardly realizable however for practical designs of ion sources. In practice, this distance d is about three millimeters.

The desire for a good mass resolution essentially has the purpose of achieving a good mass determination. However, since introduction of this method, it has been shown that good mass determination does not always lead to correct mass determination. The function which describes the mass relative to the time of flight, i.e. the calibrated mass scale, often leads to erroneous and nonreproducible mass determinations during MALDI ionization. For an ion with a mass of 5,000 atomic mass units, the result of the mass calculation can fluctuate by several mass units from scan to scan in extreme cases.

For exact mass determinations it has therefore become customary to correct the masses of the analyte ions to be determined by simultaneous scanning of ions from added known substances (so-called "internal reference substances"). As the simplest method, the mass of the analyte substances was corrected by linear extrapolation based on a relationship between the flight time and the root of the mass assumed to be linear. As reference masses, the known ions of the matrix, particularly their dimeric ion, were taken. This method leads to greatly improved accuracy in mass determination, on the order of magnitude of about 200 ppm. In this way, however, there is still an uncertainty of one mass unit for the ion with a mass of 5,000 u.

The method for improvement of mass resolution through delayed initiation of acceleration has a decisive disadvantage for exact mass determination: it provides the optimum mass resolution only in a narrow range of the total mass spectrum. In the other mass ranges, resolution is still considerably improved, but not up to its optimum value. This range of optimum resolution may be adjusted to any desired position on the mass range by changing the time lag $\tau$ or also by changing the partial accelerating voltage V, but if this is done the calibration of the mass scale normally loses its validity.

In an analysis of the criticality of all instrument parameters, we determined that one parameter which could not be kept completely constant instrumentally had an enormous influence: namely the distance d of the sample support from the intermediate acceleration electrode. Of lesser influence is the average velocity v of the ions upon initiation of the acceleration. All remaining parameters are voltages or geometric dimensions, which, can be kept very precisely constant A change in the distance d by only 100 micrometers alters the results of a mass determination by about 500 ppm, therefore an ion with a mass of 10,000 u is already measured incorrectly by five atomic mass units.

Our investigations have shown that displacements of the mass scale in regard to the calibration sometimes arise from the fact that the sample layers on the support are of different thicknesses. According to the method most widely used today, the samples are applied in solution, together with dissolved matrix substance, onto the sample support The goal is to generate small matrix crystals which contain the sample molecules. The growth of these crystals cannot be controlled; sometimes large crystals result, other times small ones, resulting in different distances d. This method is however currently being replaced by methods which produce a layer of uniform thickness, although they cannot yet be used on all substances.

However, technical problems also lead to the fact that distance d is not always constant and does not always correspond to the value provided during calibration of the mass scale. The sample supports are introduced via locks into the vacuum system of the mass spectrometer, where they are inserted into a holder which is moved by a movement device. Insertion into the slide rails of the holder with spring action positioning does not always occur as precisely as necessary due to the vacuum conditions. Narrow tolerances for the slide rails and lubricants cannot be applied in a vacuum. With metal on metal friction, the sliding jams easily in a vacuum, which is why plastic is frequently used for the slide rails, the dimensional accuracy of which is not as good as metal. Also a parallel displacement of this sample support for the scanning of different samples can easily cause a change in the distance d to the intermediate electrode on the order of magnitude of several hundredths of a millimeter.

Very frequently during analysis of biogenic material, however, there is very little analyte material available. It is also unknown whether the matrix selected leads at all to effective ionisation. Therefore a sample spectrum is often acquired before the mass spectrometer is adjusted precisely and a correction is made for an erroneous distance d. For this spectrum, the calibrated mass scale is not valid. If it then appears that the sample has already been used up by the first spectrum, this sample spectrum must then suffice for a correct mass determination. Therefore the problem is to mathematically recorrect as well as possible this sample spectrum, for which the exact flight times, but not the exact masses, of its ions are known, using known reference ions in the spectrum, so that in spite of faulty adjustments, exact masses can still be determined.

This correction of the mass determination is made more difficult in that the optimum focus range has often been set in a desired range of the spectrum by delayed ion acceleration before the scan. This displacement can be done in several ways, however as a rule, the validity of the calculated mass scale is lost.

OBJECTIVE OF THE INVENTION

It is the objective of the invention to find a correction of the flight times of a spectrum which has been measured using an incorrectly changed distance d between the sample support and intermediate electrode, so that the calibrated mass scale (=relationship for the conversion of flight times into masses) for the corrected flight times of all ion masses of the calibrated mass range remains valid within narrow error tolerances. The correction should be independent of displacements in the range of optimum focus within the mass range of the calibration. If this independence cannot be achieved, at least a method for the displacement of the focus range should be indicated for which a correction of flight times, regardless of the displacement, is possible.

BRIEF DESCRIPTION OF THE INVENTION

It is the basic idea of the invention to correct the flight times of ions from a spectrum scanned with a faultily adjusted distance d using the equation $t_{korr} \approx t+p\times c_1\times t+p\times c_2\times t^2$, and to calculate the true masses of the ions from the corrected flight times with the once calibrated mass scale. The constants $c_1$ and $c_2$, depending only on the geometry of the apparatus and the voltages used, have to be determined only once for the method. The parameter p can be determined from the deviation of the flight time of a reference ion of known mass in the spectrum from its correct flight time during calibration. As reference ions, ions from the matrix substance can particularly be used, preferably oligomeric ions.

DETAILED DESCRIPTION OF THE INVENTION

Figure 1:
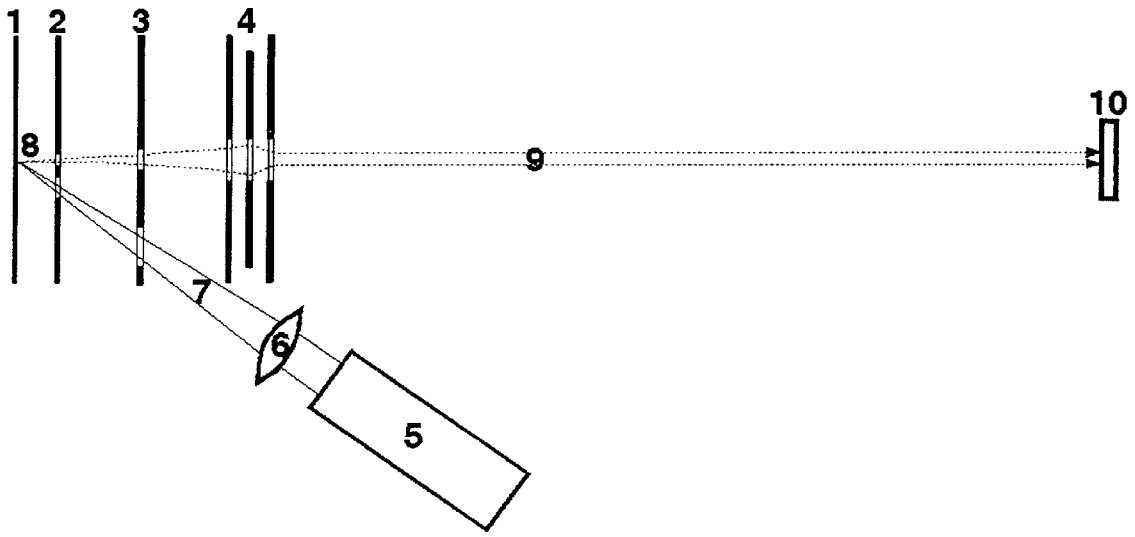
FIG. 1 shows the basic design of a time-of-flight mass spectrometer with the sample support electrode 1 at the accelerating potential U, the intermediate electrode 2 at a switchable potential, the base electrode 3 at ground potential, an ion-optical ion beam Einzel lens 4, and the ion detector 10. A light flash from laser 5 is focussed from lens 6 in a convergent light beam 7 onto sample 8, which is on sample support 1. At this time, the intermediate electrode is also at the accelerating potential U. The light flash, in a MALDI process, generates ions from the analyte substance with an initial velocity v and a large spread of velocities. After a time lag τ, the intermediate electrode 2 is switched down from potential U to potential U−V, and the ions are accelerated. They form beam 9 of the ion stream which, after passing through the flight path between base electrode 3 and detector 10, is measured by detector 10 with time resolution. The arrangement shown here has gridless acceleration electrodes as intermediate electrode 2 and base electrode 3 and therefore needs Einzel lens 4. If grids are added to the intermediate electrode 2 and base electrode 3, Einzel lens 4 is no longer necessary.

Assuming that the ions have no initial velocity, the relationship between the flight time of the ions t and the root of their mass $\sqrt{m}$ is strictly linear. In this case, linear correction of the flight time t could restore the validity of the mass calibration. Through the existence of an average initial velocity of the ions, this relationship is however no longer linear, but rather has a weak quadratic term which cannot be ignored. The quadratic term is not eliminated by improvement of the mass resolution by time-delayed ion acceleration (also described as "delayed extraction").

If we introduce the abbreviation for the root of the mass-to-charge ratio $$w = \sqrt{\frac{m}{q}}\ , \tag{1}$$

the relationship between the flight time t (measured as of switching on of acceleration, i.e. the time τ later than the ion generation by the laser flash) and the root w thus takes on the following, very simple form, whereby all non-critical parameters are united in the reduced flight path l and only the dependencies on the accelerating voltages, the distance d and the average velocity v are reproduced:

$$t = \left( \frac{l}{\sqrt{2 \times U}} + \frac{d}{\sqrt{V/2}} \right) \times w - \frac{v \times d}{V} \times w^2 = aw + bdw + cdw^2, \tag{2}$$

where U is the full accelerating voltage, V the partial accelerating voltage between the sample support and intermediate electrode, and l is a reduced flight path which is only dependent upon the geometry of the time-of-flight spectrometer and in which all other geometric dimensions are contained. The partial accelerating voltage V is switched on at time t=0 (delayed by the time τ with respect to the laser light flash) to improve the mass resolution. As described above, d is the distance between the sample support and the intermediate electrode, and v is the average velocity of the ions when switching on the acceleration. The term with $w^2$ is small compared to the linear term in w, however it attains significant influence with increasing mass. The abbreviations a, b and c have only been introduced to clarify the structure of the equation and its dependence upon distance d. .In order to get a correction for flight time t, we form the partial derivative of flight time t according to the distance d:

$$\frac{\partial t}{\partial d} = bw + cw^2, \tag{3}$$

from which, with approximation $$w \approx kt \tag{4}$$

the approximative differential equation $$t + \Delta t \approx t + \Delta d \times b \times k \times t + \Delta d \times c \times k \times t^2 = t + \Delta d \times c_1 \times t + \Delta d \times c_2 \times t^2 \tag{5}$$

is obtained. In this equation, we may now replace the unknown change Δd with the control parameter p and obtain the correction equation $$t_{korr} = t + \Delta t \approx t + p \times c_1 \times t + p \times c_2 \times t^2, \tag{6}$$

whereby parameter p can be calculated from the deviation Δt of the flight time of a reference ion mass from the "correct" flight time according to the calibrated mass scale. If equation (6), with the same value for parameter p, is used for the other flight times t, one obtains the corrected flight time for all other ions and, via the mass scale, also the approximatively correct masses. Both apparatus constants $c_1$ and $c_2$ can be determined once for one type of mass spectrometer and for a specific measurement procedure.

For a time-of-flight mass spectrometer with a distance d=3 millimeters, a second acceleration path of 30 millimeters, and a flight path of 1.6 meters, the constants are about $c_1$ =0.013 and $c_2$=−0.000019, if p approximately reflects the proportional change of d (both constants are multiplied by p, and are therefore dependent upon the choice of p).

It is therefore the basic idea of the invention to correct the flight times of ions from a spectrum scanned with a faultily adjusted distance d using the equation (6), and to calculate the true masses of the ions via the corrected flight times with the help of the calculated mass scale. The apparatus constants $c_1$ and $c_2$ have to be determined once for the method used. The parameter p is found from the deviation of the flight time of a reference ion of known mass in the spectrum from the correct flight time during calibration. As reference ions, ions from the matrix substance can particularly be used, preferably oligomeric ions.

With an experimentally introduced change in distance of 10%, the flight times were corrected by proper selection of the value for the control parameter p. The calculated mass scale was again valid with a maximum error of about 20 ppm of the mass over a mass range of 500 u to 10,000 u. This value of 20 ppm of the mass corresponds approximately to the measuring accuracy for the flight times under these conditions, which amounted to about 10 ppm. The method for improvement of the mass resolution through delayed ion acceleration provides, as already mentioned above, the optimum mass resolution only in a narrow range of the mass spectrum. In the other mass ranges, the resolution is still considerably improved, however not to its optimum value. This range of optimum resolution can be adjusted to any desired position on the mass range by changes to the time lag τ or to the partial accelerating voltage V. However, the validity of the mass scale is regularly lost at the same time.

It is therefore a finding of our experiments and thus of associated deliberations that the range of optimum resolution can be shifted in such a way that the calibrated mass scale remains valid within very narrow margins of error. The above described method for correction of flight time then remains valid.

If the mass scale is to remain valid, the range of optimum focus cannot be adjusted by a change in voltages alone. This always leads to a tipping of the mass scale and cannot be corrected electrically. It is necessary to adjust the focus range via the time lag $\tau$ and keep the field strength V/d constant in the first acceleration region. By changing $\tau$ alone, the mass scale moves slightly, however this movement can be compensated for by a slight co-control of the total accelerating voltage U while keeping the partial acceleration voltage V constant. For this purpose, the accelerating voltage can be changed linearly with $\tau$ in a simple manner. If $\tau$ is changed by the relative amount $\Delta\tau/\tau$, the second partial accelerating voltage U−V must be changed by the factor $(1+c_3\times\Delta\tau/\tau)$ This apparatus constant $c_3$ can be determined once for one type of instrument and reused over and over again. The accelerating voltage $U_s$ is thereby co-controlled as follows:

$$U_s-V=(U_c-V)\times(1+c_3\times\Delta\tau/\tau)=U_c-V+(U_c-V)\times c_3\times(\tau_s-\tau_c)/\tau_c, \text{ or simply } U_s=U_c+(U_c-V)\times c_3\times(\tau_s-\tau_c)/\tau_c, \quad (7)$$

in which $\tau_s$, is the control value of the time lag and $\tau_c$ is the value valid for calibration of the mass scale. $U_c$ is the value of the accelerating voltage during calibration. The partial accelerating voltage V must remain constant For a time-of-flight mass spectrometer with a distance d=3 millimeters, a second acceleration path of 30 millimeters and a flight path of 1.6 meters, the constant $c_3$=0.00299; for other spectrometers it can vary between 0 and 0.1.

In this way, a control can be constructed which places the range of optimum focus at any desired location on the mass scale, without allowing the calibrated mass scale to become invalid. This control can for example be installed in software to control the mass spectrometer, so that a different type of control is not even possible. The relationship between $\tau_s$ and the mass at which the optimum focus lies, can be determined easily by experiment and stored in a control table. The user then only needs to input the desired mass at which the optimum focus should be located.

It can again be demonstrated through computer simulations (and also experimentally within the scope of accuracy) that the mass scale is then valid over a very large range, for example for the range from 500 u to 10,000 u with a maximum error below 2 ppm of the mass (1 ppm of the flight time). Even at a mass of 10,000 u, the mass could still be determined exactly to within 0.02 u if the measuring accuracy would allow.

It is known that the mass resolution of small ions always remains quite good even with displacements in the optimum focus. Their line width only becomes insignificantly wider if the range of optimum focus is shifted to quite large ions. Ions of a small mass are therefore very suitable as reference masses for the above described corrections. The corrections described above also apply to time-of-flight spectrometers with energy-focusing reflectors, though other apparatus constants $c_1$, $c_2$ and $c_3$ must be applied.

PARTICULARLY FAVORABLE EMBODIMENTS

The method presented here for precise mass determination according to this invention is based upon a linear time-of-flight mass spectrometer, as shown in FIG. 1. The method of correcting the flight times by equation (6) is however also utilizable, with other values for the constants $c_1$ and $c_2$, for time-of-flight spectrometers with energy-focussing reflectors. Displacement of the optimum focus range according to equation (7) can also be applied with a constant $c_3$ for reflector mass spectrometers.

When using delayed ion acceleration as described above, the intermediate electrode 2 is initially at the potential U of the sample support 1, and is switched down after a time lag $\tau$ of several tens to hundreds of nanoseconds to the potential U−V. Operation is also possible in which both the sample support and intermediate diaphragm are initially at the potential U−V, and sample support 1 is raised to potential U after time lag $\tau$.

With this arrangement for a time-of-flight mass spectrometer, spectra of analyte substances can be acquired as usual. Spectrum acquisition begins with an ionization of the sample substances 8 on the sample support 1, as in the MALDI method of ionization described here. The ions are generated by a laser light flash of about 3 to 5 nanoseconds duration. Usually, UV light with a wavelength of 337 nanometers is used from a moderately priced nitrogen laser. The light flash is focussed through lens 6 as a convergent light beam 7 onto the sample 8 on the surface of the sample support 1. The ions formed in the vapor cloud, which is generated in the laser focus by energy absorption, are accelerated, after the time lag $\tau$, first in the electrical field between sample support 1 and intermediate electrode 2, and then in the electrical field between intermediate electrode 2 and base electrode 3. The ion beam slightly defocussed in the electrode arrangement is focussed in the Einzel lens 4 onto the detector 10 at the beginning of the flight path. The flying ions form a strongly time variable ion current 9, which is measured at the end of the flight path by ion detector 10 with high temporal resolution.

Through the special MALDI process, mass signals can be generated at the detector which have a temporal width of less than one nanosecond, even though the light flash of the laser has a temporal length of 3 to 5 nanoseconds.

The time variable ion current provided by the ion beam is usually measured and digitalized at the detector with a scanning rate of 1 or 2 gigahertz. Transient recorders with even higher temporal resolution will soon be available. Usually, the measured ion current values from several scans are cumulated before the mass lines in the stored data are investigated for signal peaks, and the signal peaks are transformed from time values into mass values via the calibration curve.

The polarity of the high voltage used for the ion acceleration must be the same as the polarity of the ions being analyzed: positive ions are repelled and accelerated by a positively charged sample support, negative ions by a negatively charged sample support.

Of course, the time-of-flight mass spectrometer can also be operated in such a way that the flight path is in a tube (not shown in FIG. 1), which is at accelerating potential U, while the sample support 1 is at base potential. In this special case, the flight tube is at a positive potential if negatively charged ions are to be analyzed, and vice versa This operation simplifies the design of the ion source, since the isolators for the holder of the exchangeable sample support 1 are no longer necessary. However, there are disadvantages in other areas.

The following problem has occurred frequently in precise and exact mass determination using the MALDI ionization method:

(a) Through the technique of exchangeable sample supports, which must be brought through a lock into the vacuum and held there, a constancy of the distance d to the intermediate diaphragm is not guaranteed with the tolerance of less than 10 micrometers necessary for exact mass determination.

(b) Frequently, very little analyte substance is available. Contrary to expectations, this is sometimes consumed during the scan of a first sample spectrum, even without having corrected the distance of the sample support to the intermediate electrode using mechanical or electrical measures. The mass determination must then be carried out as well as possible using the sample spectrum obtained from the analyte substance.

(c) During calibration of the mass scale, the range of optimum focus must be set permanently to an arbitrary mass. This focus range had been adjusted however for the sample scan to expected analyte masses.

Under these conditions, can the masses or flight times be subsequently corrected? This problem is solved by this invention.

The focus range can be shifted as desired by control of the time lag $\tau_s$ the mass scale remaining valid if the accelerating voltage $U_s$ is changed in parallel according to equation (7). If this type of displacement of the focus range is permanently installed in the computer control of the mass spectrometer and no other controls of the adjustment are permitted, this displacement of the focus range will not harm any later correction measures since the mass scale remains valid under these conditions.

A faulty adjustment of the distance d can be corrected for under these circumstances.

To do this, it is also necessary to measure a reference substance of known mass. In most cases, such reference ions are already available in the form of ions of the matrix substance. It has become apparent that monomer ions are not well suited due to their much too high intensity and the resulting overloading of the measurement device. Furthermore their mass is so far down on the lower end of the mass spectrum that extrapolation into the desired mass range is unfavorable. In most spectra however, there are dimeric ions in the correct intensity range, sometimes even trimeric or even higher oligomeric ions. These lines are very sharp and more suitable due to their higher mass. Using these reference ions, a correction of all flight times for all ion signals can now be made, designed in such a way that the flight times of reference ions resume their flight time valid during the calibration. The correction follows quadratic equation (6).

At first, the correction parameter p from equation (6) can be determined from the deviation $\Delta t$, the flight time of the reference ions exhibit from their correct flight time. The parameter p can be obtained from the flight time difference $\Delta t$ of the reference ions with flight time t according to equation (6):

$$p=\Delta t/(c_1\times t+c_2\times t^2) \tag{8}$$

After determination of p, the flight times of all ion masses of interest are corrected with equation (6), using the same value p. The corrected flight times are then converted via the calibration curve of the mass scale into masses. The masses thus determined agree with the true masses excepting very minimal errors (under 20 ppm).

The considerations discussed here for linear mass spectrometers also apply, as any specialist can appreciate, to time-of-flight mass spectrometers with energy-focussing reflectors. Here, for the adjustment of the optimum focus range, the reflector voltages must be co-controlled in the same manner as the accelerating voltages U. For this type of mass spectrometer, different constants $c_1$, $c_2$ and $c_3$ then apply.

The method of precise mass determination given here with a time-of-flight spectrometer according to this invention can of course be varied in many ways. The specialist in development of mass spectrometers and their measurement methods can easily realize these variations.

We claim:

1. Method for approximately exact mass determination of analyte ions in a time-of-flight mass spectrometer using internal reference samples and a once calibrated mass scale, with ionization of the substances by matrix-assisted laser desorption (MALDI) and with improvement of the mass resolution by delayed ion acceleration in the region between sample support and intermediate acceleration electrode, comprising the steps (a) acquiring a flight time spectrum of analyte ions including reference substance ions, (b) determining the correction parameter $p=\Delta t_r/(c_1\times t_r+c_2\times t_r^2)$ from the flight time difference $\Delta t_r$ between the calibrated flight time and the measured flight time $t_r$ of the reference ions, $c_1$ and $c_2$ being calibrated method constants, (c) correcting flight times t of interesting ions according $t_{corr}\approx t+p\times c_1\times t+p\times c_2\times t^2$, and (d) calculating the approximately accurate ion masses from the corrected flight times $t_{corr}$ using the once calibrated mass scale.

2. Method according to claim 1, wherein additionally adjustments of the range of best focus are made by control of the time lag $\tau_s$, coupled with co-control of the total accelerating voltage $U_s$ without changing the partial accelerating voltage V according to the equation $U_s=U_c+(U_c-V)\times c_3\times(\tau_s-\tau_c)/\tau_c$, in which $U_c$ is the total accelerating voltage given during calibration of the mass scale, V is the partial accelerating voltage between the sample support and intermediate electrode, $\tau_c$ is the time lag used for the calibration, and $c_3$ is an apparatus constant.

3. Method according to claim 2, wherein the constants $c_1$, $c_2$ and $c_3$ are determined by a one time calibration of a mass spectrometric method of the same type.

4. Method according to claim 2, wherein the ion masses to be exactly determined are shifted into the range of optimum mass resolution of the delayed ion acceleration method.

5. Method according to claim 1 or claim 2, wherein the monomeric, dimeric or oligomeric ions of the MALDI matrix substance are used as reference ions.

* * * * *